US006786772B1

(12) United States Patent
Liu

(10) Patent No.: US 6,786,772 B1
(45) Date of Patent: Sep. 7, 2004

(54) MODULATED CONNECTOR

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 10/414,294

(22) Filed: Apr. 16, 2003

(51) Int. Cl.[7] ..... H01R 24/00
(52) U.S. Cl. ..... 439/620; 439/541.5; 439/676
(58) Field of Search ..... 439/676, 620, 439/541.5, 76.1

(56) References Cited

U.S. PATENT DOCUMENTS 6,174,198 B1 * 1/2001 Wu et al. ..... 439/541.5
6,183,292 B1 * 2/2001 Chen et al. ..... 439/541.5
6,474,999 B1 * 11/2002 Givens et al. ..... 439/76.1
6,537,110 B1 * 3/2003 Korsunsky et al. ..... 439/676
6,623,306 B2 * 9/2003 Xu et al. ..... 439/676
6,682,365 B1 * 1/2004 Walker et al. ..... 439/488

* cited by examiner

*Primary Examiner*—Gary Paumen
(74) *Attorney, Agent, or Firm*—Varndell & Varndell, PLLC

(57) ABSTRACT

A modulated connector includes an input module, a transfer module and an applied terminal module. The input module has at least one resilient leg set adapted to connect to other electrical elements. The transfer module is connected to the input module via a circuit board and has a substantially U-shaped pin seat with two sets of pins to correspond to the side holes of the circuit board. The applied terminal module is connected to the transfer circuit board and has two side circuit boards respectively and electrically connected to the transfer module and a base electrically connected to the side circuit boards and provided with multiple contacting pins extending through the base for connection with another electrical device.

20 Claims, 12 Drawing Sheets

MODULATED CONNECTOR

BACKGROUND OF THE INVENTION

1. Field of the Invention

The present invention relates to a modulated connector, and more particularly to a modulated connector having an input module, a transfer module and an applied terminal module. With the modularized connector, the assembly speed is increased and test for defects can be performed during the assembly.

2. Description of Related Art

Connectors such as RJ45, RJ11, Rj12 are often used in the computers for connection with the INTERNET. Although these connectors function to transfer signals, certain factors such as cross-talk and other interference may have to be taken into consideration to avoid damage to the quality of signal. In most cases, the common method to avoid interference and cross-talk is to add in passive elements such as a resistor or inductor to the transfer of the connector. However, the addition of the passive elements adds complexity to the structure of the connector. Besides, tests for defects of the connector can not be performed until the entire assembly process of the connector is finished. Therefore, there is no way for the operator to find out and amend connection defects of the connector during assembly, which is quite a waste.

To overcome the shortcomings, the present invention tends to provide an improved modulated connector to mitigate and obviate the aforementioned problems.

SUMMARY OF THE INVENTION

The primary objective of the present invention is to provide an improved modulated connector having an input module, a transfer module and an applied terminal module such that the assembly speed is able to be increased.

Another objective of the present invention is to provide an improved modulated connector enabling the operator to perform connection tests during the assembly of the connector so that defective modules can be eliminated before the completion of the connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
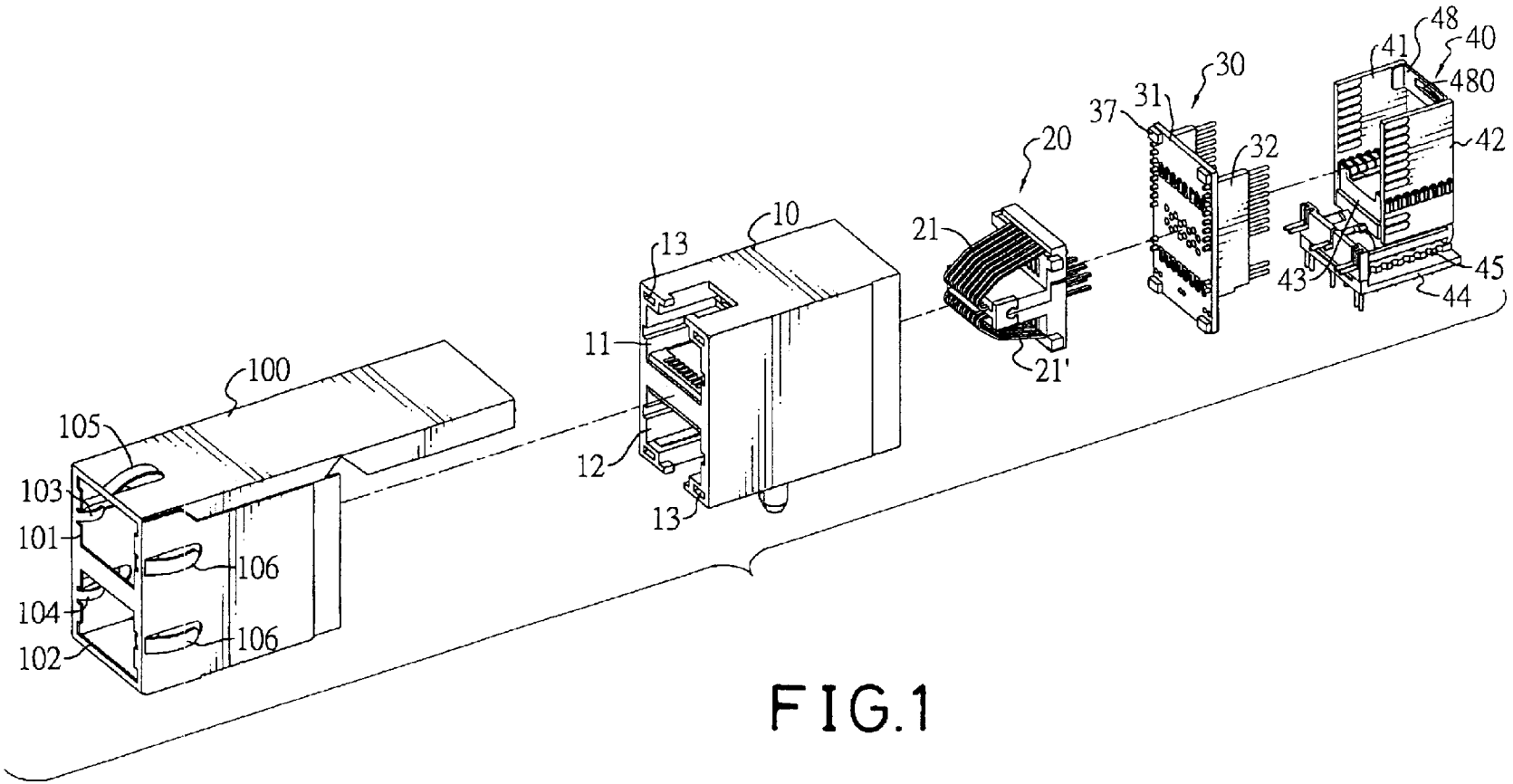
FIG. 1 is an exploded perspective view of the modulated connector of the present invention.

With reference to FIG. 1, the modulated connector in accordance with the present invention includes a cover (10), a metal housing (100), an input module (20), a transfer module (30) and an applied terminal module (40).

The input module (20) includes two resilient leg sets (21,21') symmetrically abutted to one another. The transfer module is electrically connected to the two resilient leg sets (21,21') of the input module via a circuit board (31). The applied terminal module (40) is securely connected to the transfer module to adapt to connect to other electrical elements.

Figure 2:
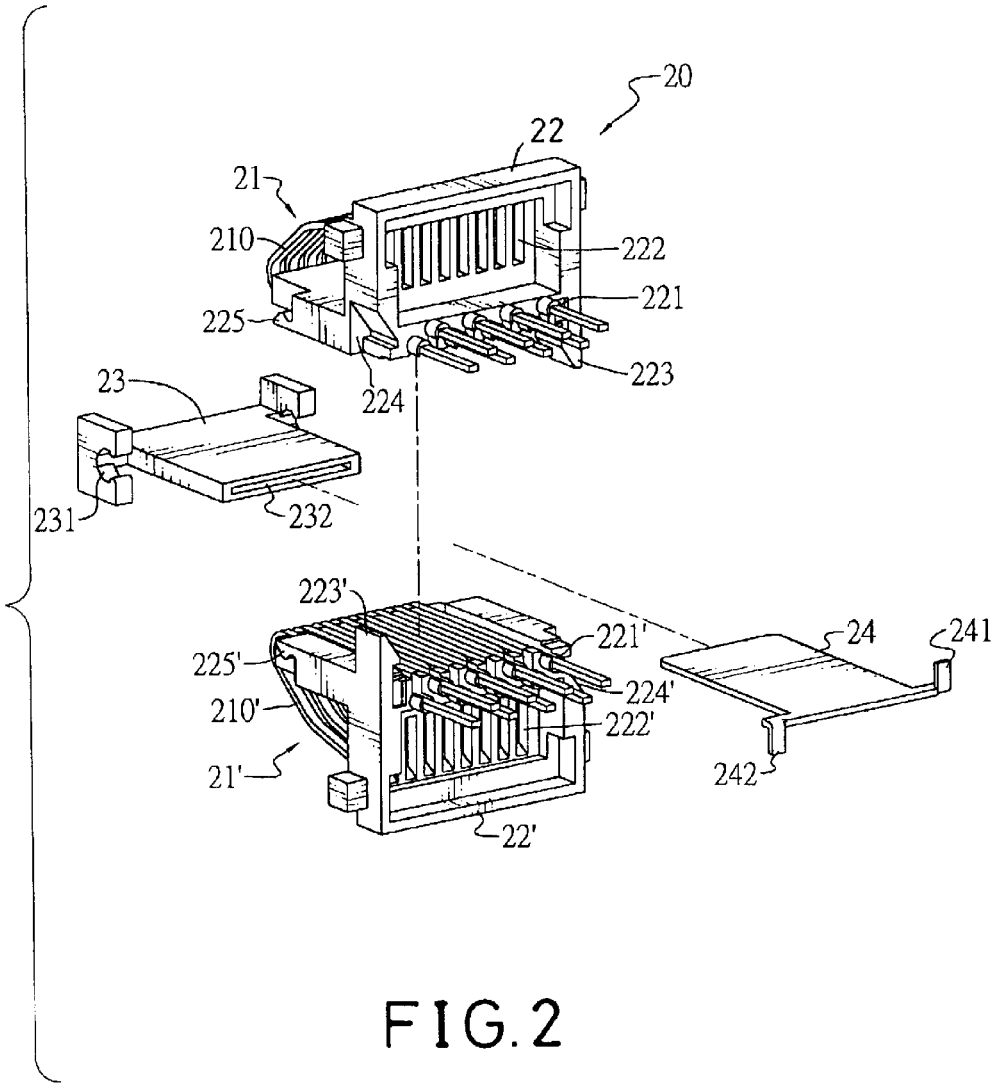
FIG. 2 is an exploded perspective view of the input module of the present invention.

With reference to FIG. 2, the input module (20) further has two identical L-shaped seats (22,22') oppositely abutted to each other and each has through a set of holes (221,221') defined through the horizontal section of the respective seats (22,22'), a grill (222,222') defined in the vertical section of the respective seats (22,22') to correspond to the through holes (221,221'), resilient legs (210,210') each having a first end securely extending out from a corresponding one of the through holes (221,221') and a second end movably received in a corresponding one of the grills (222,222'), a hook (223) extending from a joint of the vertical section and the horizontal section of the respective seats (22,22'), a notch (224) defined in the respective seat (22,22') opposite to the hook (223), two securing ears (225,225') respectively formed on two opposite sides of the respective seats (22,22'), an isolation plate (23) and a grounding plate (24).

The isolation plate (23) has two clamping rings (231) respectively formed on opposite sides of the isolation plate (23) to correspond to the securing ears (225,225') and a hole (232) defined through the isolation plate (23).

The grounding plate (24) has a first extension plate (241) and a second extension plate (242) extending out from the grounding plate (24) in a direction opposite to that of the first extension plate (241).

When the input module (20) is in assembly, the two seats (22,22') are oppositely abutted to one another with the isolation plate (23) sandwiched between the two resilient leg sets (21,21') and the grounding plate (24) inserted into the hole (232) of the isolation plate (24). Then the hook (223) of each of the seats (22,22') clamps a corresponding one of the notches (224) to secure engagement of one side of the two seats (22,22'). Thereafter, the two securing ears (225,225') are combined and inserted into a corresponding one of the two clamping rings (231) of the isolation plate (23). After the securing ears (225,225') are received in the corresponding clamping rings (231), the first and second extension plates (241,242) abut a side face of the vertical section of the respective seats (22,22').

Figure 3:
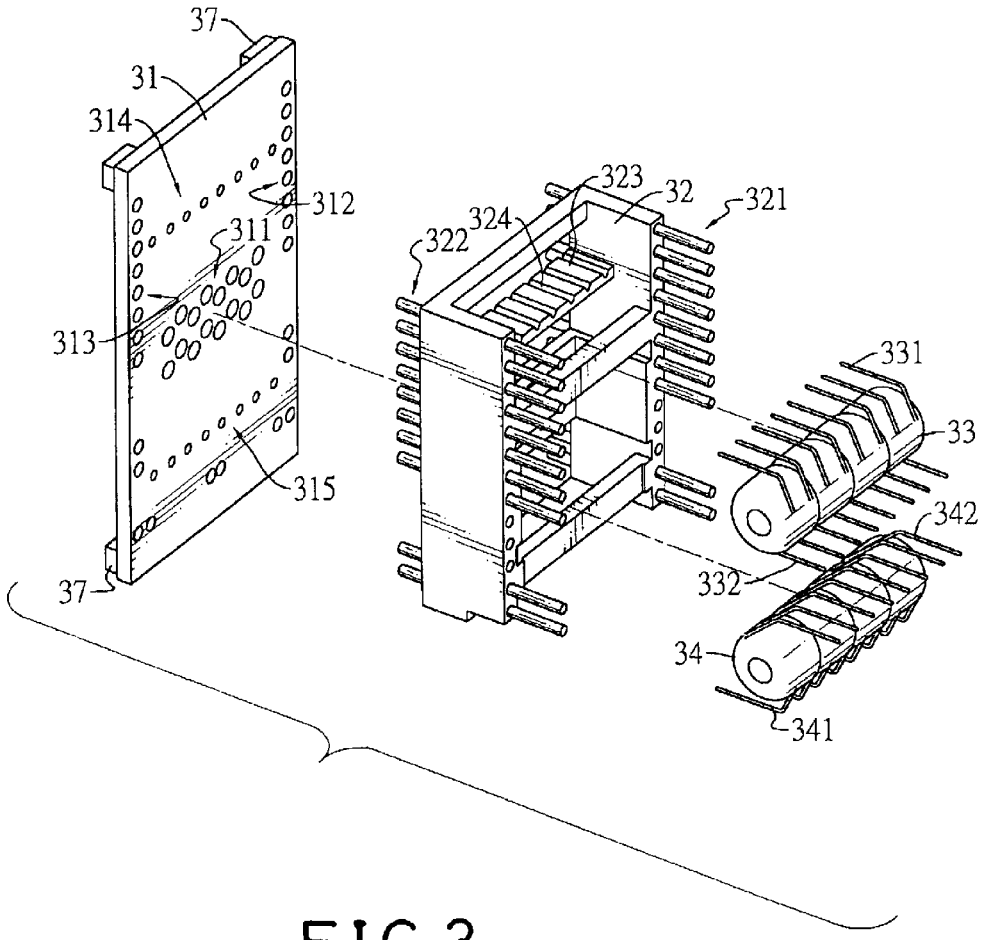
FIG. 3 is an exploded perspective view of the transfer module of the present invention.

With reference to FIG. 3 and taking FIG. 1 for reference, the transfer module (30) includes a circuit board (31), a pin seat (32) and passive elements (33,34).

The circuit board (31) has central holes (311) defined in a central portion of the circuit board (31) to correspond to the resilient legs (210,210') of the input module (20), side holes (312,313) oppositely defined in an edge of the circuit board (31) and through holes (314,315) oppositely defined in a top edge and a bottom edge of the circuit board (31). The pin seat (32) is substantially U-shaped and has two sets of pins (321,322) oppositely extending from a side of the pin seat (32) to correspond to the side holes (312,313) of the circuit board (31), a separation plate (323) oppositely formed on a top portion and a bottom portion of the pin seat (32) between two side walls of the pin seat (32) and having grooves (324) formed on a top face of the separation plate (323). The passive elements in this preferred embodiment are coils (33,34) each having first ends (331,341) received in the grooves (324) of both the separation plates (323) and second ends (332,342) corresponding to the resilient legs (210,210') of the resilient leg sets (22,22'). The first ends (331,341) further correspond to the through holes (314,315) of the circuit board (31).

Figure 4:
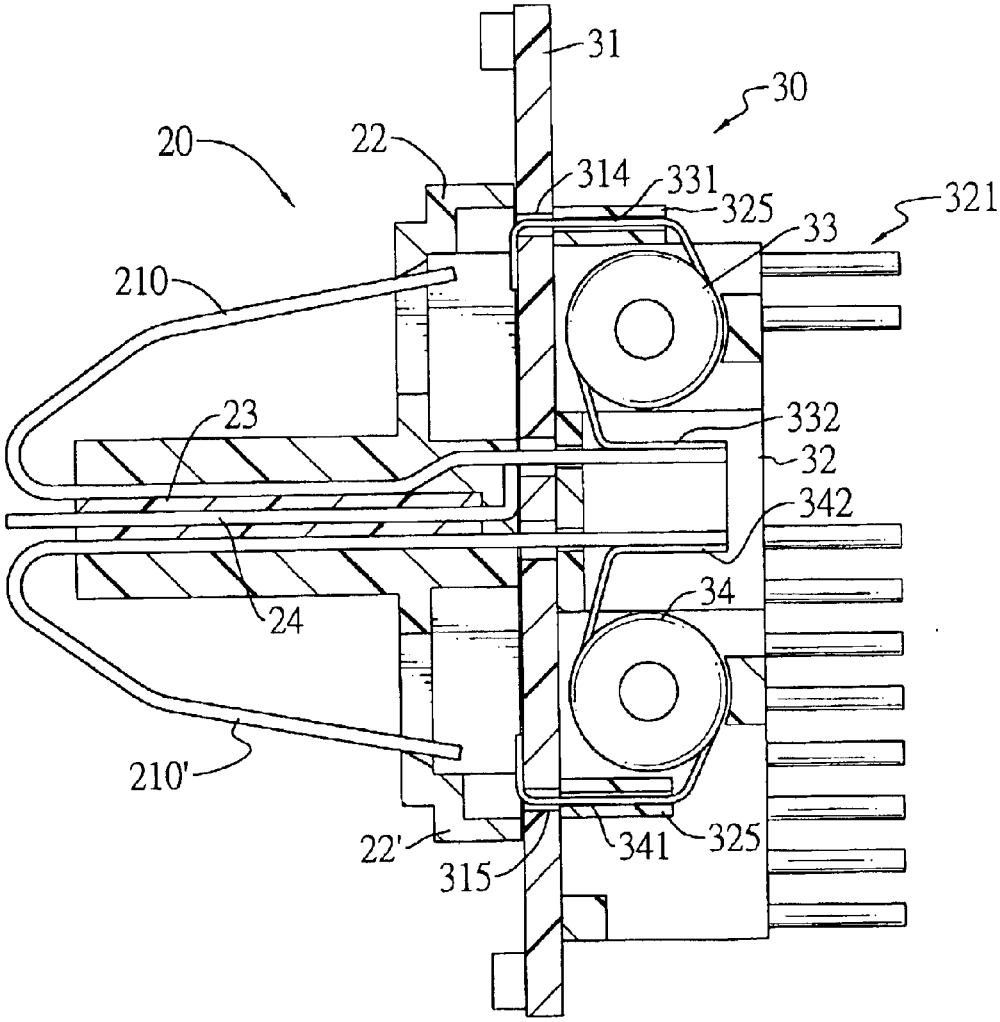
FIG. 4 is a schematic side view in partial section of the assembly of the input module and the transfer module.

With reference to FIG. 4, when the transfer module (30) is in assembly with the input module (20), the pins (321,322) from opposite sides of the pin seat (32) extend through the corresponding side holes (312,313) of the circuit board (31) and then firmly engage with the circuit board (31) to have electrical connection with the circuit board (31). Thereafter, the first ends of the resilient legs (210,210') extend through the central holes (311) and have secure engagement with the circuit board (31). Thus, signals from the input module (20) are able to be transmitted to the circuit board (31). Again, due to the wiring (not shown) on the circuit board (31), the signals are able to be relayed to the pins (321,322). Furthermore, after the first ends of the resilient legs (210, 210') extend through the central holes (311), the first ends (331,341) of the coils (33,34) extend into the corresponding through holes (314,315) and the second ends (332,342) respectively engage with the first ends of the resilient legs (210,210'). Therefore, signals from the input module (20) are first transmitted from the resilient legs (210,210') to the second ends (332,342) of the coils (33,34) and then to the pins (321,322).

Figure 5:
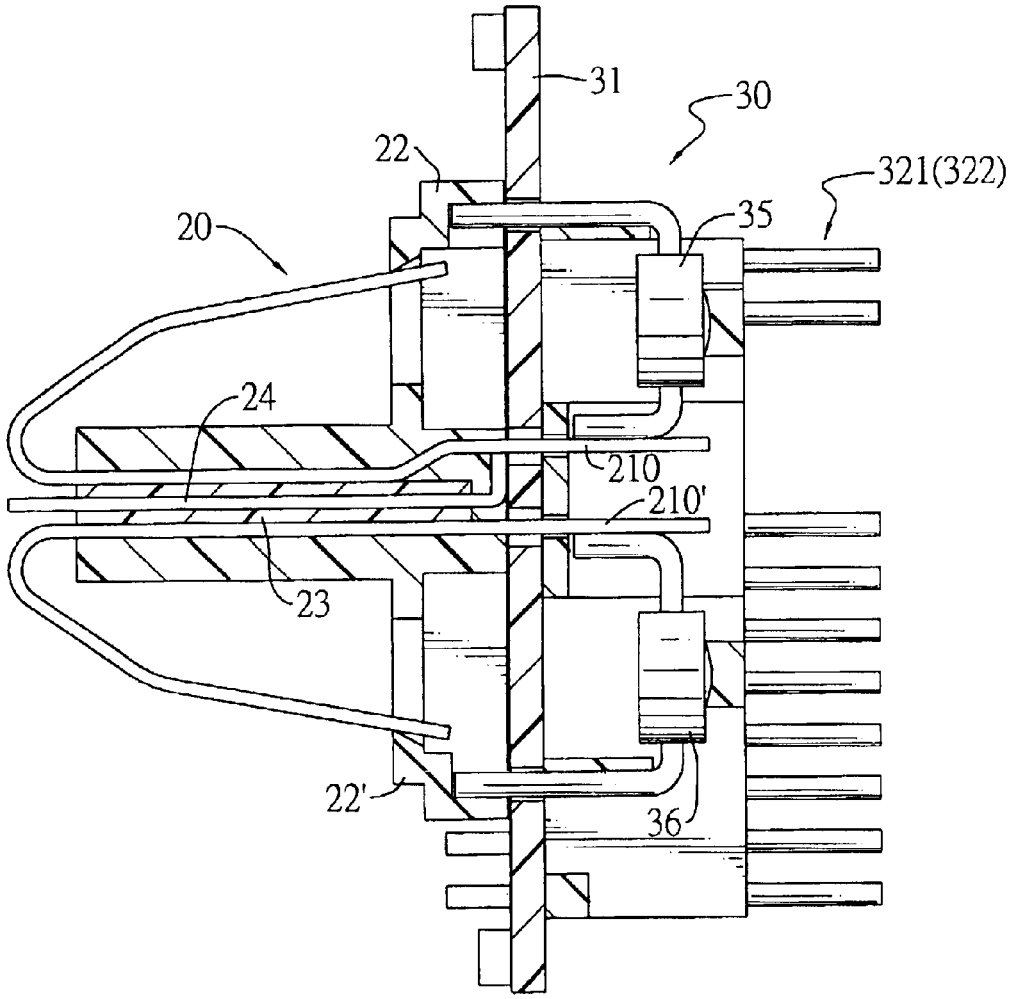
FIG. 5 is a schematic side view in partial section of the assembly of the input module and the transfer module, wherein a different passive element is added to the assembly between the input module and the transfer module.

With reference to FIG. 5, the passive elements (35,36) may be in the form as shown in the drawing and having distal ends of a type different to the coils (33,34).

Figure 6:
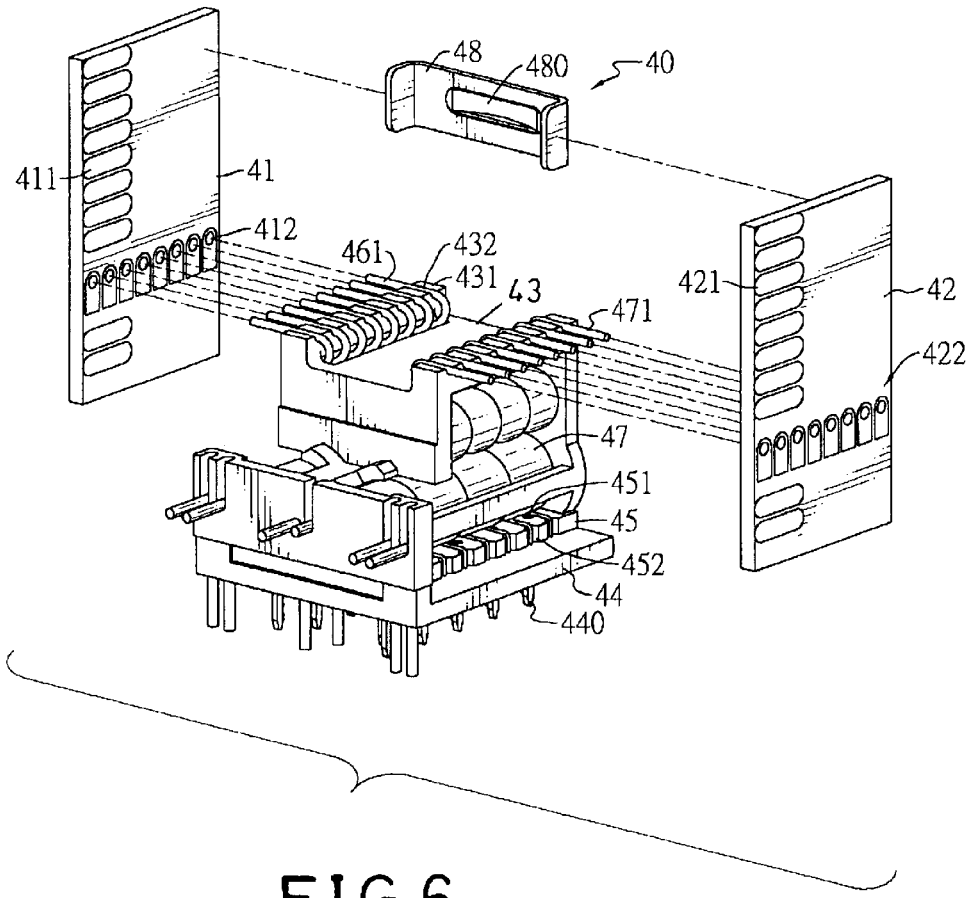
FIG. 6 is an applied terminal module of the present invention.
Figure 7:
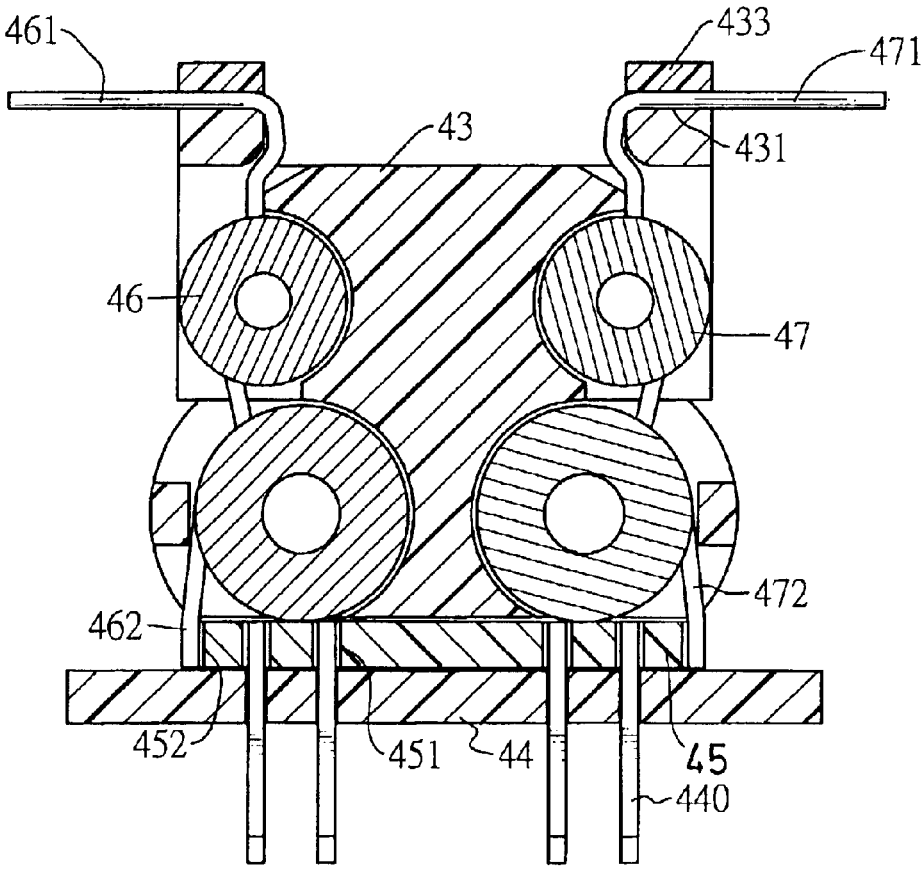
FIG. 7 is a schematic side view with partial in section showing the assembly of the applied terminal module of the present invention.

With reference to FIGS. 1, 6 and 7, the applied terminal module (40) includes two side circuit boards (41,42), a fixing seat (43), a base (44), a wiring board (45), first and second coils (46,47) and a ground (48).

Each of the side circuit boards (41,42) has contacts (411, 421) formed on a side of the respective side circuit board (41,42) to correspond to the pins (321,322) and conducting holes (412,422) laterally defined in the respective circuit board (41,42).

The wiring board (45) having multiple extension holes (451) therethrough is mounted on the base (44) so that each contacting pin (440) which is securely formed on the base (44) extends through a corresponding one of the extension holes (451). Cutouts (452) are defined in two opposite sides of the wiring board (45) to electrically connect to the extension holes (451) via wiring (not shown) on the wiring board (45).

The fixing seat (43) has a space defined in opposite sides of the fixing seat (43) to receive therein passive elements, such as coils (46,47). The fixing seat (43) has two extensions (431) respectively formed on two opposite sides of the fixing seat (43) and having grooves (432) defined in a top face of each extension (431). The coils (46,47) each have first ends (461,471) received in and extending out of the grooves (432) to correspond to the conducting holes (412,422) of the side circuit board (41,42) respectively and second ends (462,472) extending out and into the cutouts (452). Therefore, signals from the side circuit boards (41,42) are able to be sent to the coils (46,47) and the wiring board (45) and then are transmitted out from the contacting pins (440) of the base (44).

The ground (48) is substantially U-shaped to connect wiring on the respective side circuit board (41,42). The ground (48) has a resilient plate (480) formed on a mediate portion to connect to the metal housing (100) to complete grounding of the connector.

Because each element of the connector is modularized, assembly of the connector is to connect one modularized element to one another so that the assembly speed is increased. Furthermore, before assembling the metal housing (100) and the cover (10), the modulated elements are electrically connected to one another. Therefore, the operator is able to perform connection tests in order to remove the defective elements from the modulated elements whereby acceptable quality elements are saved, which saves cost and is efficient.

Figure 8:
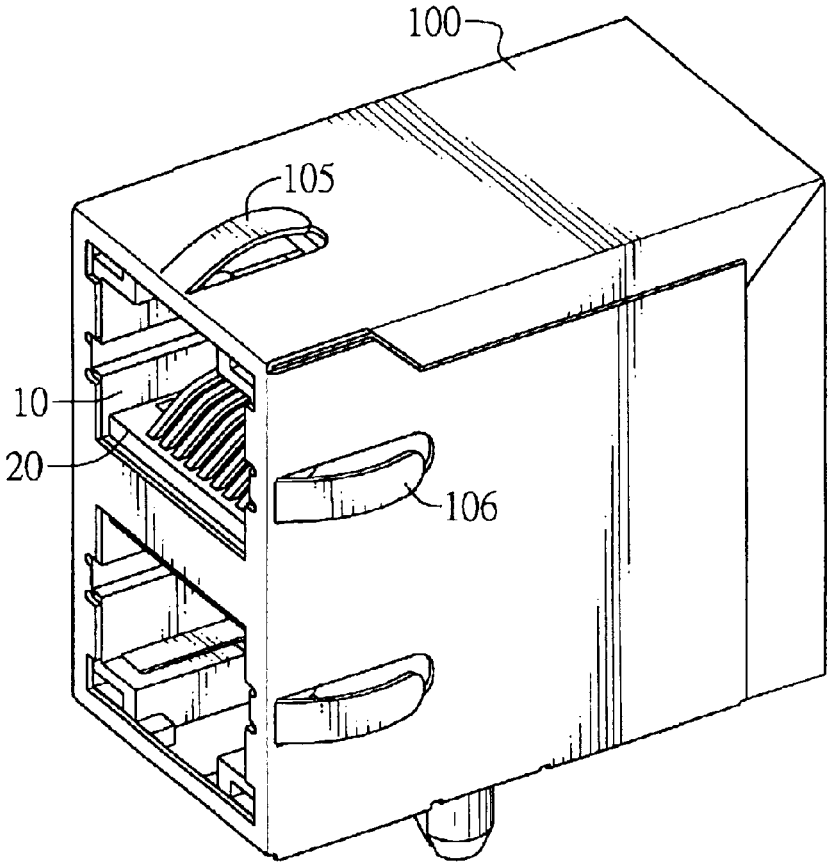
FIG. 8 is a perspective view of the connector of the present invention.
Figure 9:
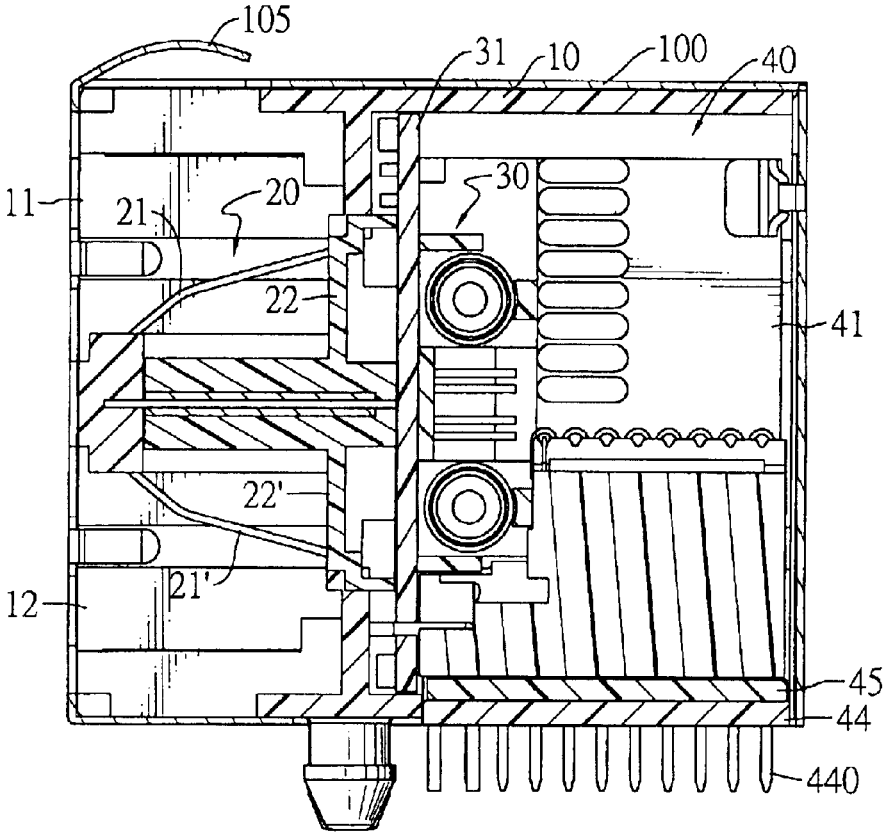
FIG. 9 is a cross sectional view of the connector in FIG. 8.

With reference to FIGS. 8 and 9, after the assembly of the input module (20), the transfer module (30) and the applied terminal module (40), the combination of the input module (20), the transfer module (30) and the applied terminal module (40) are inserted into the cover (10). In order to cope with the double-deck design of the assembly including the input module (20), the transfer module (30) and the applied terminal module (40), the cover (10) has a first opening (11) and a second opening (12) to respectively correspond to the resilient legs (21,21') so that after the resilient legs (21,21') are respectively inserted into the first and second openings (11,12), the input module (20) is ready for further connection with other electrical elements.

The metal housing (100) has a first window (101) and a second window (102) to respectively correspond to the first opening (11) and second opening (12) of the cover (10). A first biasing plate (103) is formed on an inner face of the first window (101) and a second biasing plate (104) is formed on an inner face of the second window (102). With the formation of the first and second biasing plate (103,104), when the cover (10) is received in the metal housing (100), the engagement therebetween is secured. Furthermore, a third biasing plate (105) is formed on a top face of the metal housing (100) and at least one (two are shown) fourth biasing plate (106) is formed on a side face of the metal housing (100), such that when the metal housing (100) is adapted to connect to other electrical elements, the engagement therebetween is secured.

Figure 10:
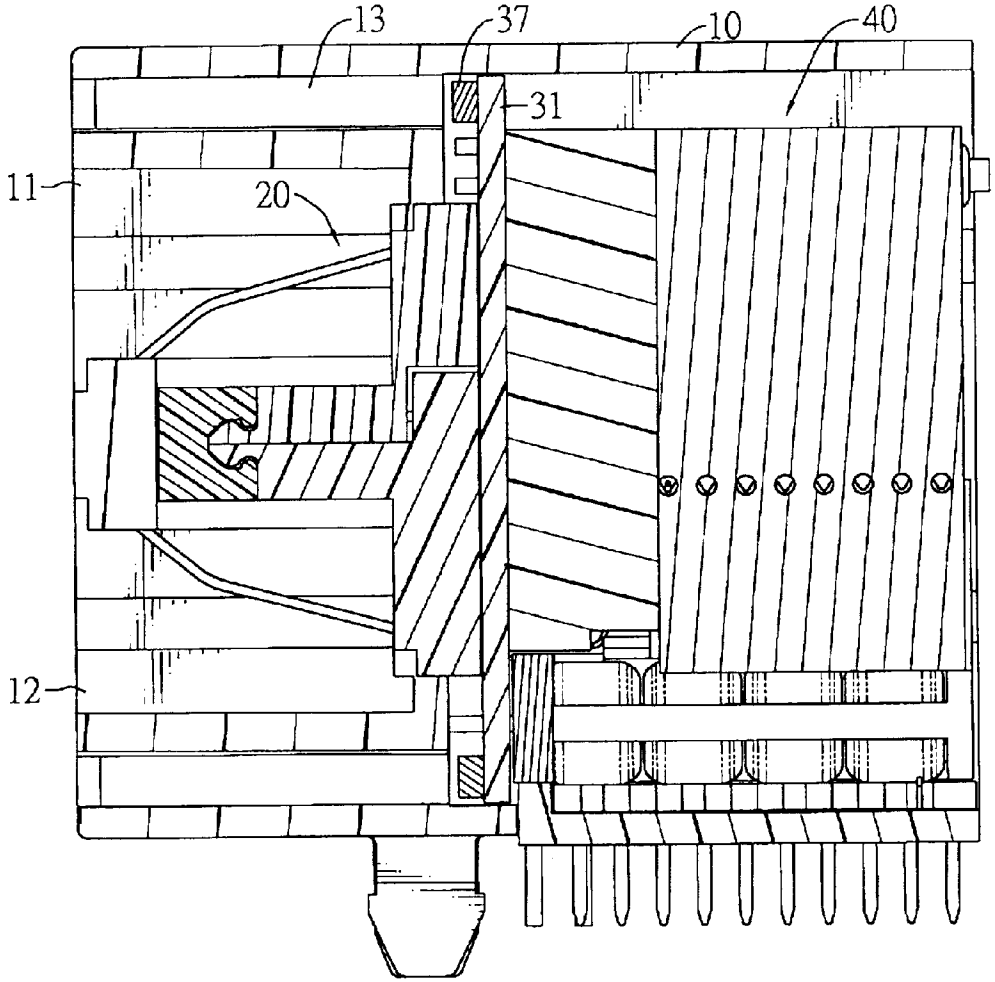
FIG. 10 is a cross sectional view of the housing in combination with the assembled input module, the transfer module and the applied terminal module.

With reference to FIG. 10 and still taking FIG. 1 for reference, another feature of the present invention is to have an indication light. The cover (10) has four channels (13) respectively defined in each corner of the cover (10) and the circuit board (31) of the transfer module (30) has four light emitting diodes (LED) (37) respectively formed on each corner of the circuit board (31) to correspond to the channels (13) so that when the combination of the input module (20), the transfer module (30) and the applied terminal module (40) is inserted into the cover (10), each LED (37) corresponds to one of the channels (13). When the LEDs (37) are lit, the light is able to be transmitted as an indicator out of the cover (10) and the metal housing (100).

Figure 11:
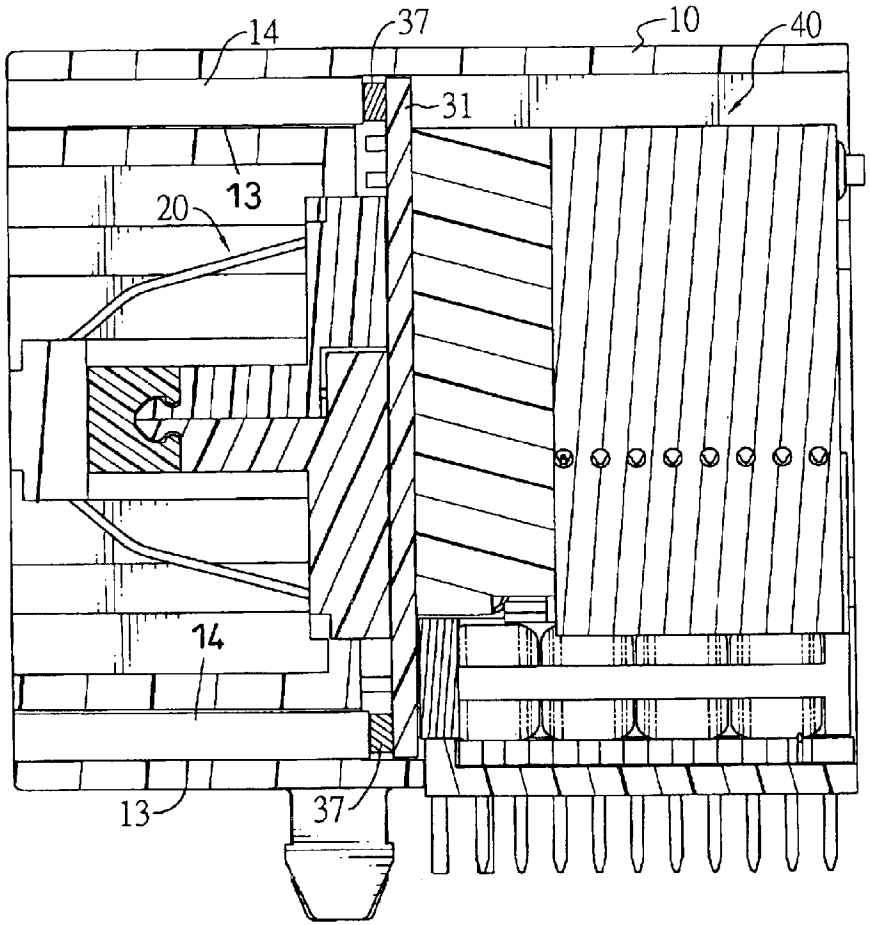
FIG. 11 is a cross sectional view of another embodiment of the housing in combination with the assembled input module, the transfer module and the applied terminal module.
Figure 12:
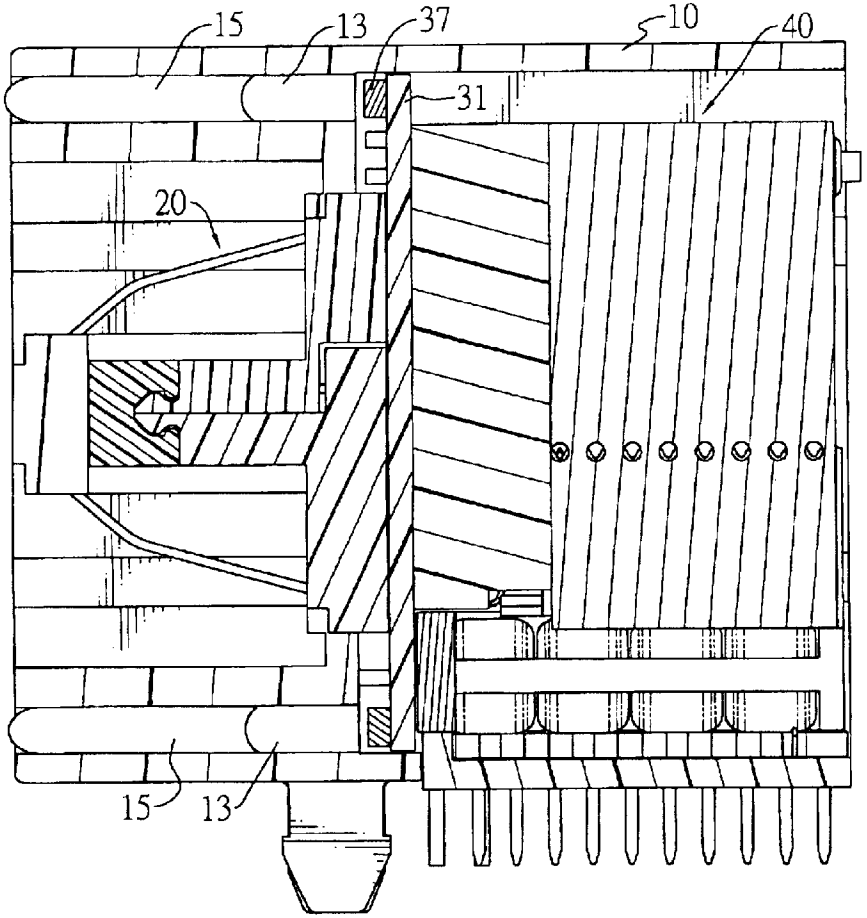
FIG. 12 is a cross sectional view of still another embodiment of the housing in combination with the assembled input module, the transfer module and the applied terminal module.

In order to enhance the indication light of the modulated connector of the present invention, a light conducting material (14) is inserted into each channel (13), as shown in FIG. 11, such that when the LEDs (37) are lit, the light of the LEDs (37) is able to be transmitted out from the light conducting material (14). With reference to FIG. 12, four lenses (15) are respectively inserted into the channel (13) so that the light from the LEDs (37) is able to be enhanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modulated connector comprising:

an input module having at least one resilient leg set adapted to connect to other electrical elements;

a transfer module connected to the input module via a circuit board which has side holes oppositely defined in an edge of the circuit board and through holes oppositely defined in a top edge and a bottom edge of the circuit board, wherein the transfer module has a substantially U-shaped pin seat with two sets of pins oppositely extending from a side of the pin seat to correspond to the side holes of the circuit board, a separation plate oppositely formed on a top portion and a bottom portion of the pin seat and between two side walls of the pin seat, the separation seat having grooves defined in a top face of the separation plate and passive elements each having first ends received in the grooves and extending into the through holes of the circuit board and second ends corresponding to resilient legs of the at least one resilient leg set;

an applied terminal module connected to the transfer circuit board and having two side circuit boards respectively and electrically connected to the transfer module and a base electrically connected to the side circuit boards and provided with multiple contacting pins extending through the base for connection with another electrical device.

2. The modulated connector as claimed in claim 1, wherein the input module has two resilient leg sets, two L-shaped seats oppositely abutted to each other and each seat having through holes defined through a horizontal section of the seat, a grill defined in a vertical section of the seat to correspond to the through holes such that first ends of resilient legs of a corresponding one of the two resilient leg sets securely extend out from the through holes and second ends movably received in the grill.

3. The modulated connector as claimed in claim 2, wherein the L-shaped seat has a hook extending from a joint of the vertical section and the horizontal section of the L-shaped seat, a notch opposite to the hook and securing ear formed on two opposite sides of each of the L-shaped seat, such that the hook from one L-shaped seat is able to be received in the notch of the other L-shaped seat and the securing ear from each of the L-shaped seats are able to be combined together.

4. The modulated connector as claimed in claim 3, wherein the input module further has an isolation plate sandwiched between the two resilient leg sets to separate the two resilient legs, the isolation plate provided with a clamping ring formed on opposite sides of the isolation plate to correspond to the securing ears of the respective L-shaped seat and a hole defined through the isolation plate to receive therein a grounding plate.

5. The modulated connector as claimed in claim 4, wherein the grounding plate has two oppositely extended extension plates to abut the two L-shaped seats.

6. The modulated connector as claimed in claim 1, wherein the circuit board of the transfer module has central holes defined in a central portion of the circuit board to correspond to the resilient legs of the input module.

7. The modulated connector as claimed in claim 2, wherein the circuit board of the transfer module has central holes defined in a central portion of the circuit board to correspond to the resilient legs of the input module.

8. The modulated connector as claimed in claim 3, wherein the circuit board of the transfer module has central holes defined in a central portion of the circuit board to correspond to the resilient legs of the input module.

9. The modulated connector as claimed in claim 4, wherein the circuit board of the transfer module has central holes defined in a central portion of the circuit board to correspond to the resilient legs of the input module.

10. The modulated connector as claimed in claim 5, wherein the circuit board of the transfer module has central holes defined in a central portion of the circuit board to correspond to the resilient legs of the input module.

11. The modulated connector as claimed in claim 10, wherein the passive elements in the transfer module are coils.

12. The modulated connector as claimed in claim 11, wherein each side circuit board further has contacts formed on a side of the respective side circuit board to correspond to the pins of the transfer module and conducting holes laterally defined in the respective circuit board to correspond to first ends of second passive elements which are received between the two side circuit boards and have second ends electrically connected to the contacting pins.

13. The modulated connector as claimed in claim 12, wherein the applied terminal module further has a wiring board mounted on the base and having multiple extension holes therethrough so that each contacting pin extends through a corresponding one of the extension holes, and cutouts defined in two opposite sides of the wiring board to receive therein the second ends of the second passive elements and to electrically connect to the extension holes.

14. The modulated connector as claimed in claim 13, wherein the applied terminal module further has a ground sandwiched between the two side circuit boards and having a resilient plate formed on a mediate portion of the ground to avoid a short of the connector.

15. The modulated connector as claimed in claim 14 further comprising a cover having a first opening, a second opening to respectively correspond to the resilient legs of the input module and a channel defined in each corner of the cover to correspond to light emitting diodes respectively formed on the circuit board of the transfer module so that lights from the light emitting diodes are able to be transmitted out from the channels.

16. The modulated connector as claimed in claim 15, wherein a light conducting material is inserted in each of the channels to direct light from the light emitting diodes.

17. The modulated connector as claimed in claim 15, wherein a lens is inserted in each of the channels to enhance light from the light emitting diodes.

18. The modulated connector as claimed in claim 15 further comprising a metal housing having a first window and a second window to respectively correspond to the first opening and second opening of the cover, and a first biasing plate formed on an inner face of the first window and a second biasing plate formed on an inner face of the second window so that when the cover is received in the metal housing, the engagement therebetween is secured.

19. The modulated connector as claimed in claim 17 further comprising a metal housing having a first window and a second window to respectively correspond to the first opening and second opening of the cover, and a first biasing plate formed on an inner face of the first window and a second biasing plate formed on an inner face of the second window so that when the cover is received in the metal housing, the engagement therebetween is secured.

20. The modulated connector as claimed in claim 18, wherein the metal housing further has a third biasing plate formed on a top face of the metal housing and at least one fourth biasing plate formed on a side face of the metal housing, such that when the metal housing is adapted to connect to other electrical elements, the engagement therebetween is secured.

* * * * *